US009624760B2

(12) United States Patent
Yuan

(10) Patent No.: US 9,624,760 B2
(45) Date of Patent: Apr. 18, 2017

(54) METHOD FOR FAST AND UNIFORM SAGD START-UP ENHANCEMENT

(71) Applicant: BitCan Geosciences & Engineering Inc., Calgary (CA)

(72) Inventor: Yanguang Yuan, Calgary (CA)

(73) Assignee: Bitcan Geosciences + Engineering, Calgary (CA)

( * ) Notice: Subject to any disclaimer, the term of this patent is extended or adjusted under 35 U.S.C. 154(b) by 668 days.

(21) Appl. No.: 13/906,531

(22) Filed: May 31, 2013

(65) Prior Publication Data

US 2014/0352966 A1 Dec. 4, 2014

(51) Int. Cl.
*E21B 43/24* (2006.01)

(52) U.S. Cl.
CPC ..... *E21B 43/2408* (2013.01)

(58) Field of Classification Search
CPC ..... E21B 43/2406; E21B 43/24
See application file for complete search history.

(56) References Cited

U.S. PATENT DOCUMENTS

| | | | |
|---|---|---|---|
| 3,058,730 | A | 10/1962 | Bays |
| 3,284,281 | A | 11/1966 | Thomas |
| 3,501,201 | A | 3/1970 | Closmann et al. |
| 3,593,791 | A | 7/1971 | Parker |
| 3,613,785 | A | 10/1971 | Closmann et al. |
| 3,706,341 | A | 12/1972 | Redford |
| 3,709,295 | A | 1/1973 | Braunlich, Jr. et al. |
| 3,965,982 | A | 6/1976 | Medlin |
| 4,005,750 | A | 2/1977 | Shuck |
| 4,612,989 | A | 9/1986 | Rakach et al. |
| 4,733,726 | A | 3/1988 | Alameddine et al. |
| 4,754,808 | A | 7/1988 | Harmon et al. |
| 4,830,106 | A | 5/1989 | Uhri |
| 4,889,186 | A | 12/1989 | Hanson et al. |

(Continued)

FOREIGN PATENT DOCUMENTS

| | | |
|---|---|---|
| CA | 1235652 | 4/1988 |
| CA | 1286217 | 7/1991 |

(Continued)

OTHER PUBLICATIONS

Bouteca, M., Lessi, J., Sarda, J.P., Stress Changes Induced by Fluid Injection in a Porous Layer Around a Wellbore, Communication Presented on Behalf of the Technical Committee of Group D'Etude de la Gazeification Souterraine du Charbon (G.E.G.S.), Jun. 1983, pp. 99 to 106.

(Continued)

*Primary Examiner* — Catherine Loikith

(57) ABSTRACT

A method is taught for creating a laterally-continuous, vertically-oriented dilation zone connecting the two SAGD wells. A method is taught for drilling and completing the SAGD wells in a formation, conditioning said wells to create a stress condition favorable for forming a dilation zone, injecting one or both of said two wells with a stimulant at pressures greater than the in-situ minimum stress of the formation to initiate the dilation zone connecting said SAGD wells and continuing stimulant injection into a first of said two wells while maintaining a target pressure at a second of said two wells to propagate the dilation zone homogenously along the well length.

49 Claims, 5 Drawing Sheets

$\sigma_{H_{min}} < \sigma_{H_{max}}$

(56) References Cited

U.S. PATENT DOCUMENTS

| | | | | |
|---|---|---|---|---|
| 5,025,859 | A | 6/1991 | Hanson et al. | |
| 6,012,520 | A | 1/2000 | Yu et al. | |
| 7,104,320 | B2 | 9/2006 | Buchanan et al. | |
| 2006/2136580 | | 9/2006 | Nishimura | |
| 2013/0032336 | A1* | 2/2013 | Abbate et al. ..... | 166/250.01 |

FOREIGN PATENT DOCUMENTS

| | | |
|---|---|---|
| CA | 1323561 | 10/1993 |
| CA | 2611928 | 12/2006 |
| CA | 2663823 | 4/2008 |
| CN | 102678096 | 9/2012 |
| RU | 2176021 | 11/2001 |

OTHER PUBLICATIONS

Gadelle, C., Lessi, J., Sarda, JP., Underground Coal Gasification at Great Depth: The French Field Test of Bruay-en-Artois, Conference paper, date unknown, France.

* cited by examiner $\sigma_{H_{min}} < \sigma_{H_{max}}$

METHOD FOR FAST AND UNIFORM SAGD START-UP ENHANCEMENT

FIELD OF THE INVENTION

The present invention relates to methods for stimulating subterranean formations via geomechanical dilation to start up steam-assisted gravity drain (SAGD) well production.

BACKGROUND OF THE INVENTION

Extraction of petrochemicals from subterranean formations is an important global industry. However, in North America and many parts of the world, petrochemicals are found in heavy, viscous forms such as bitumen, which are extremely difficult to extract. The bitumen-saturated oilsands reservoirs of Canada, Venezuela, California, China and other parts of the world are just some examples of such subterranean formations. In these formations, it is not possible to simply drill wells and pump out the oil. Instead, the reservoirs are heated or otherwise stimulated to reduce viscosity and promote extraction.

The two most common and commercially-proven methods of stimulating oilsands reservoirs are (a) cyclic steam stimulation (CSS) and (b) steam assisted gravity drainage (SAGD). In both cases, steam is injected into the reservoir, to heat up the bitumen. Some variations of these processes may involve injecting solvent to aid the viscosity reduction or use electrical heating to replace the role of steam.

In general, the initial injectivity into the reservoir, i.e., how much volume of the stimulant can be injected per unit of time without fracturing the formation, is relatively small. Stimulation of the reservoir is desired to provide channels via which the stimulant can travel to access and contact the reservoir. These channels not only increase injectivity, but also increase the contact area of stimulant within the reservoir.

In SAGD processes, before the production can start, communication between the SAGD well pair must be established so that the bitumen can flow down from an upper injection well to a lower production well. Conventionally, steam is circulated through the two wells independently until the inter-well area is heated and the bitumen viscosity is reduced significantly so that it can flow to the production well and material communication is established. This process normally takes up to 6 months to complete. More time may be needed in some situations such as when the well trajectory drilled deviates from the ideal pattern of vertically-aligned with 5 m apart.

The art of hydraulic fracturing as a stimulation method for hydrocarbon resource recovery has been practiced for a long time. In general, this method injects liquid at high pressures into a well drilled through the target formation to be stimulated. The high pressure initiates a fracture from the injection well and propagates a sufficient distance into the formation. Then, the fracture is filled with proppants that are injected from the surface after the fracture is formed. The similar method is applied in vertical and horizontal wells and wells of any inclinations. However, the existing art of hydraulic fracturing is subject to two major limitations:

- Hydraulic fracturing has no proactive control of the orientation of the fracture formed. The fracture follows the plane perpendicular to the least resistance, i.e., perpendicular to the original in-situ minimum stress, $S_{min0}$. If a horizontal well is drilled in the direction of minimum stress $S_{min0}$ or substantially inclined towards it, a fracture being formed via conventional hydraulic fracturing may be perpendicular or substantially perpendicular to the horizontal well. Such fractures do not contribute to the uniform communication between the SAGD wells along their length.
- Selective placement of hydraulically-driven fractures in the plane perpendicular to the original in-situ maximum stress, $S_{max0}$, has been practiced in the past. However these typically require a sacrificial well, which adds cost to drilling and completion of the SAGD well pair. Moreover, the sacrificial fracture formed in the process will complicate steam conformance and thus makes inter-well communication difficult between the SAGD well pair.

As a norm, many local inhomogeneities exist in the in-situ conditions and in the operating well conditions along the SAGD well length. Given these inhomogeneities, whether manually-induced or pre-existing along the well length, it is highly unlikely that the fracture formed in conventional hydraulic fracturing can propagate uniformly or continuously along the length of the horizontal wells, which can span over 800 m, unless the horizontal well length is segmented to be treated at different times.

The goal of the conventional hydraulic fracturing stimulation is to form a fracture, more specifically an open fracture which represents a geomechanically thin linear or planar defect. It is often tensile in mechanical nature and modeled by two parallel plates with an open aperture between. Pressure or fluid conductivity through such an open fracture is often very high. If an open fracture is formed between the SAGD wells locally along the well length, essentially no pressure drop occurs along the fracture. Thus, it can lead to continuous propagation along its linear or planar path and it does not promote lateral propagation of the fracture, i.e., uniform propagation along the SAGD well length.

There has been some work done in controlling the orientation of fractures. For example, U.S. Pat. No. 3,613,785 by Closmann (1971) teaches creating a horizontal fracture from a first well by vertically fracturing the formation from a second well and then injecting hot fluid to heat the formation. Heating via the vertical fracture alters the original in-situ stress so that the vertical stresses become smaller than horizontal stresses, thus favouring a horizontal fracture being formed. This method requires a first sacrificial vertical fracture be formed and uses costly steam to heat the formation.

U.S. Pat. No. 3,709,295 by Braunlich and Bishop (1971) controlled the direction of hydraulic fractures by employing at least three wells and a natural fracture system. This method is only feasible in formations already having existing fractures.

U.S. Pat. No. 4,005,750 by Shuck (1975) teaches creating an oriented fracture in the direction of the minimum in-situ stress from a first well by first hydraulically fracturing another well to condition the formation. Again, additional wells and sacrificial fractures are required before the targeted fracture can be formed.

Canadian patent CA 1,323,561 by Kry (1985) teaches creating a horizontal fracture from a center well after cyclically steam-stimulating at least one peripheral well. At the peripheral well a vertical fracture is created. CSS operations coupled with fracturing at the peripheral well conditions the stress field so that a horizontal fracture can be formed. To create the horizontal fracture, a high-viscosity fluid is proposed to inject into the center well to limit the fluid from leaking into the formation.

Canadian patent CA 1,235,652 by Harding et al. (1988) teaches first vertically-fracturing the formation from peripheral wells to alter or condition the in-situ stress regime in the center region of the peripheral wells. The formation is then fractured through a central well to create and extend a horizontal fracture.

All of the above documents require either the existence of a natural fracture in the formation already or the formation of sacrificial fractures before a targeted fracture can be induced. Furthermore, many of these documents have specific requirements for heated or highly viscous injection fluids to condition the formation or to induce the targeted fracture.

SUMMARY OF THE INVENTION

A method is taught for creating a laterally-continuous, vertically-oriented dilation zone connecting the two SAGD wells. The method comprises the steps of drilling and completing the SAGD wells in a formation, conditioning said wells to create a stress condition favorable for forming a dilation zone, injecting one or both of said two wells with a stimulant at pressures greater than an in-situ minimum stress of the formation to initiate the dilation zone connecting said SAGD wells and continuing stimulant injection into a first of said two wells while maintaining a target pressure at a second of said two wells to propagate the dilation zone homogenously along the well length.

DESCRIPTION OF THE DRAWINGS

The invention will now be described in further details with reference to the following drawings, in which.

DETAILED DESCRIPTION OF THE PREFERRED EMBODIMENTS

Figure 1:
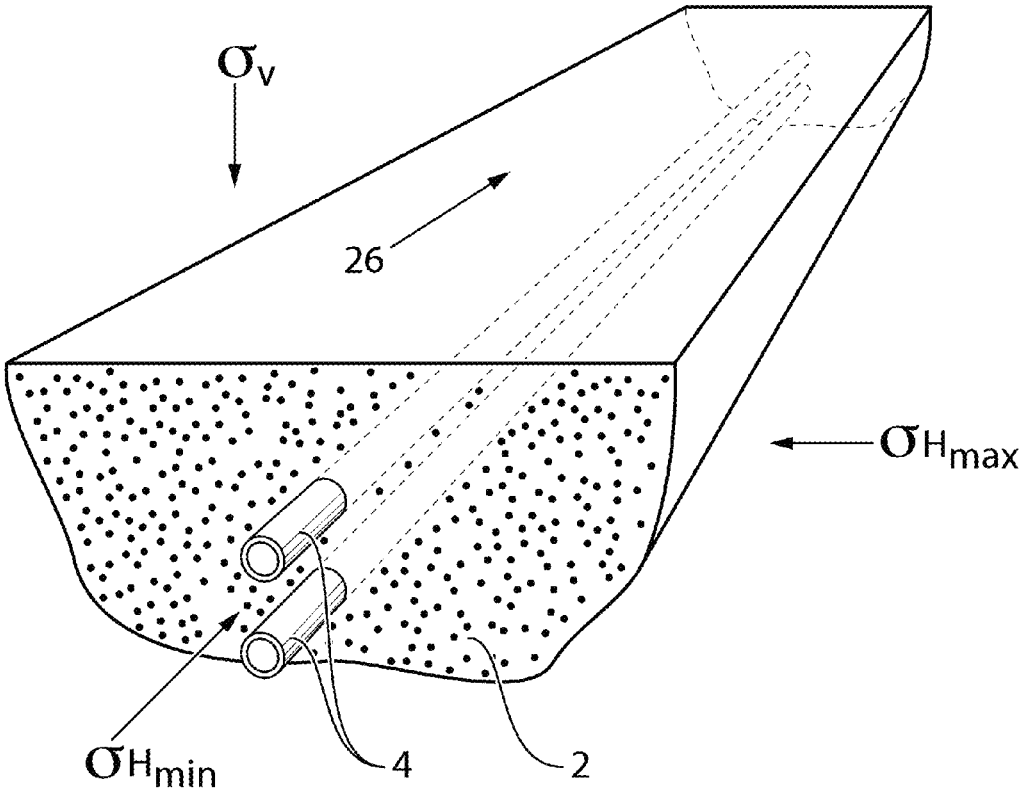
FIG. 1 illustrates a porous subterranean formation drilled with two substantially parallel, vertically coplanar horizontal wells.
Figure 2A:
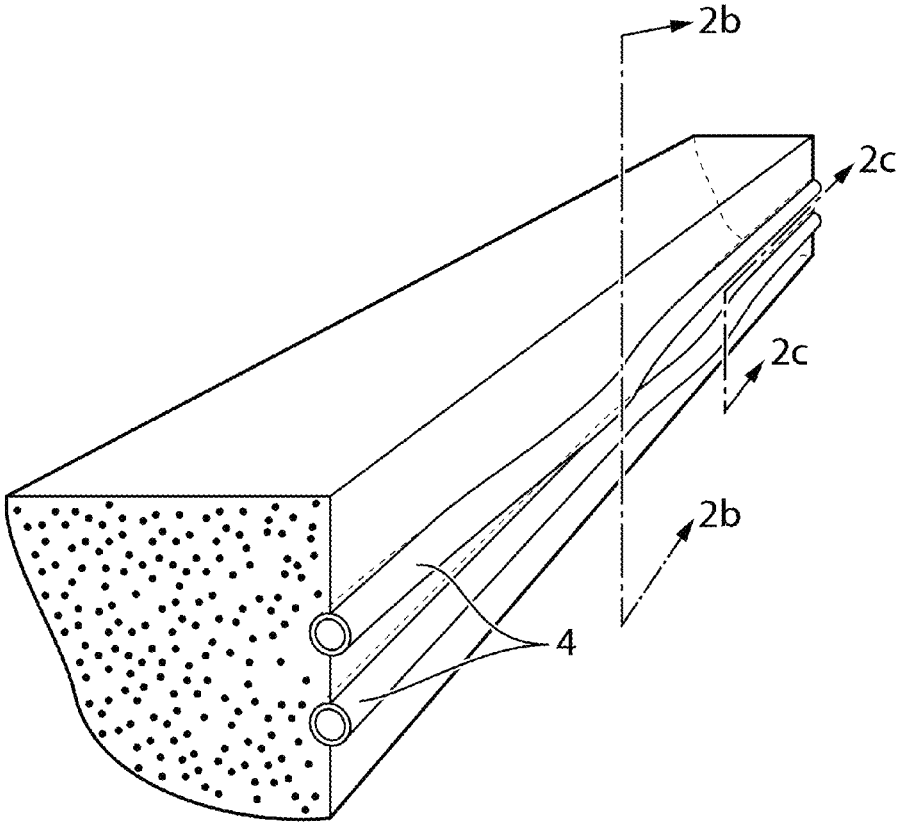
FIGS. 2*a* to 2*e* illustrate some examples of local inhomogeneities and well variances seen in SAGD well drilling and completion.
Figure 2B:
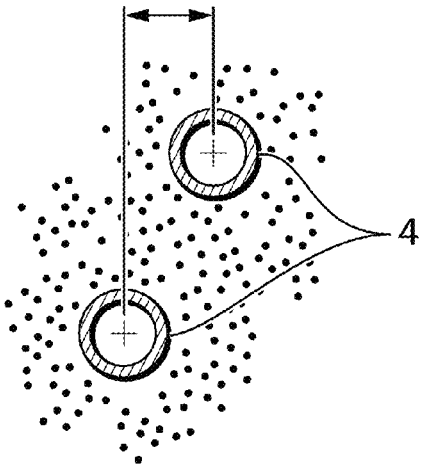
Figure 2C:
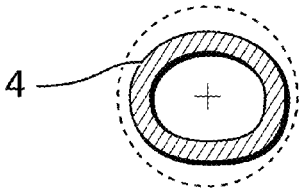
Figure 2D:
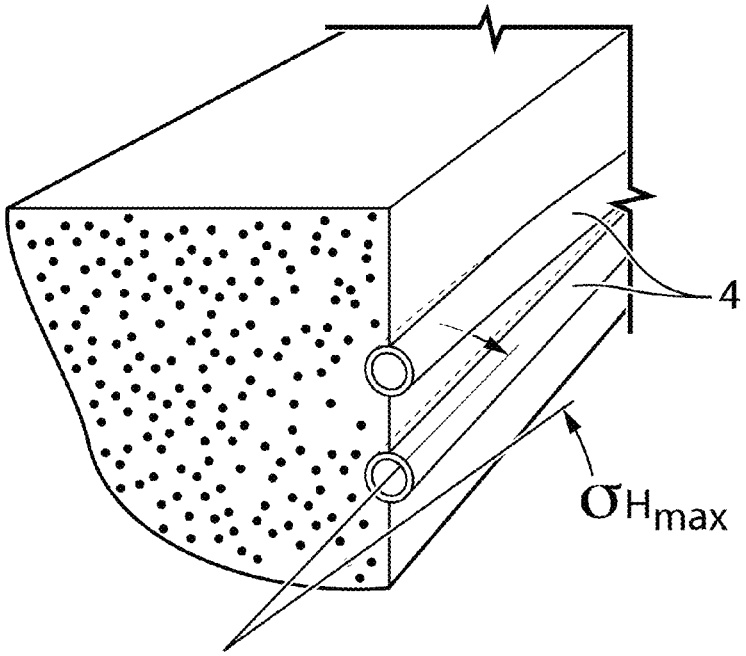
Figure 2E:
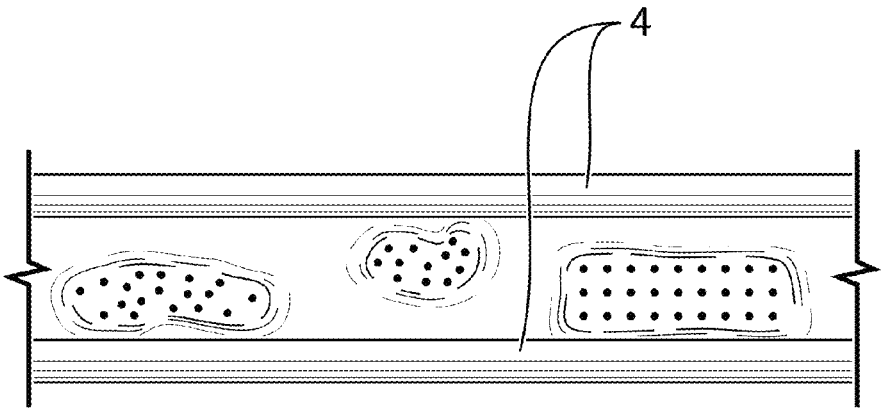

The present invention provides a method of managing the failure mode in subterranean formations to favor the formation of one or more dilation zones, manage the orientation of the dilation zones connecting a SAGD well pair and further managing the lateral uniform extension of the dilation zone along the SAGD well length without segmenting the well length using complex downhole packer systems. It further provides ways to transition from dilation to normal SAGD production.

The present invention serves to modify the original stress field around the SAGD wells so that a dilation zone, not a fracture zone, is formed to connect the SAGD wells. The present invention also promotes uniform dilation along the SAGD well length regardless of local inhomogeneities that may exist along the well length.

For the purposes of the present invention, dilation is defined as a porosity increase under overall compressive stress conditions. Two modes of dilation are promoted in the present invention: shear-induced dilation and tensile micro-crack dilation. In shear-induced dilation, grain-to-grain contacts between sand in the formation remain intact, but they roll over each other, altering the originally densely-packed state of grain-to-grain contacts and thus, increasing the porosity. In tensile micro-crack mode of dilation, the majority of grain-to-grain contact also remains intact, but grain-to-grain detachments may exist locally which form small tensile microcracks. Since these grain-to-grain detachments are isolated, they do not form a continuous open fracture. A dilation zone has a larger finite thickness than an open fracture, occupying a larger volume. Resistance to fluid flow through the dilation zone is higher than through an open fracture.

The present inventors have found that via poroelastic and/or thermoelastic mechanisms, the original in situ stress profile of the formation can be changed, and thereby the orientation of induced dilation zones can also be formed to a near-vertical orientation, connecting the two substantially horizontal SAGD wells. The present method does not require one or more sacrificial fractures being formed a prior for the preconditioning. Furthermore, it does not depend whether or not the original in-situ stress field favors the formation of a near-vertical dilation zone.

The present invention does not form a macroscopic tensile open aperture connecting the two SAGD wells. Instead, it forms a zone of high-porosity structurally-altered sands materials between the SAGD wells which is called a dilation zone. This zone may have tensile microcracks embedded. But the microcracks do not form a continuous pathway. As a result, along the dilation zone, there is still some noticeable resistance to the fluid flow. This enables the dilation to extend laterally along the SAGD well length, causing a near-vertical dilation zone extending uniformly in a horizontal direction.

The process is well suited to oilsands reservoirs such as those in Alberta and Saskatchewan, Canada. However, the process can be applied to any formations which can be dilated.

Figure 5:
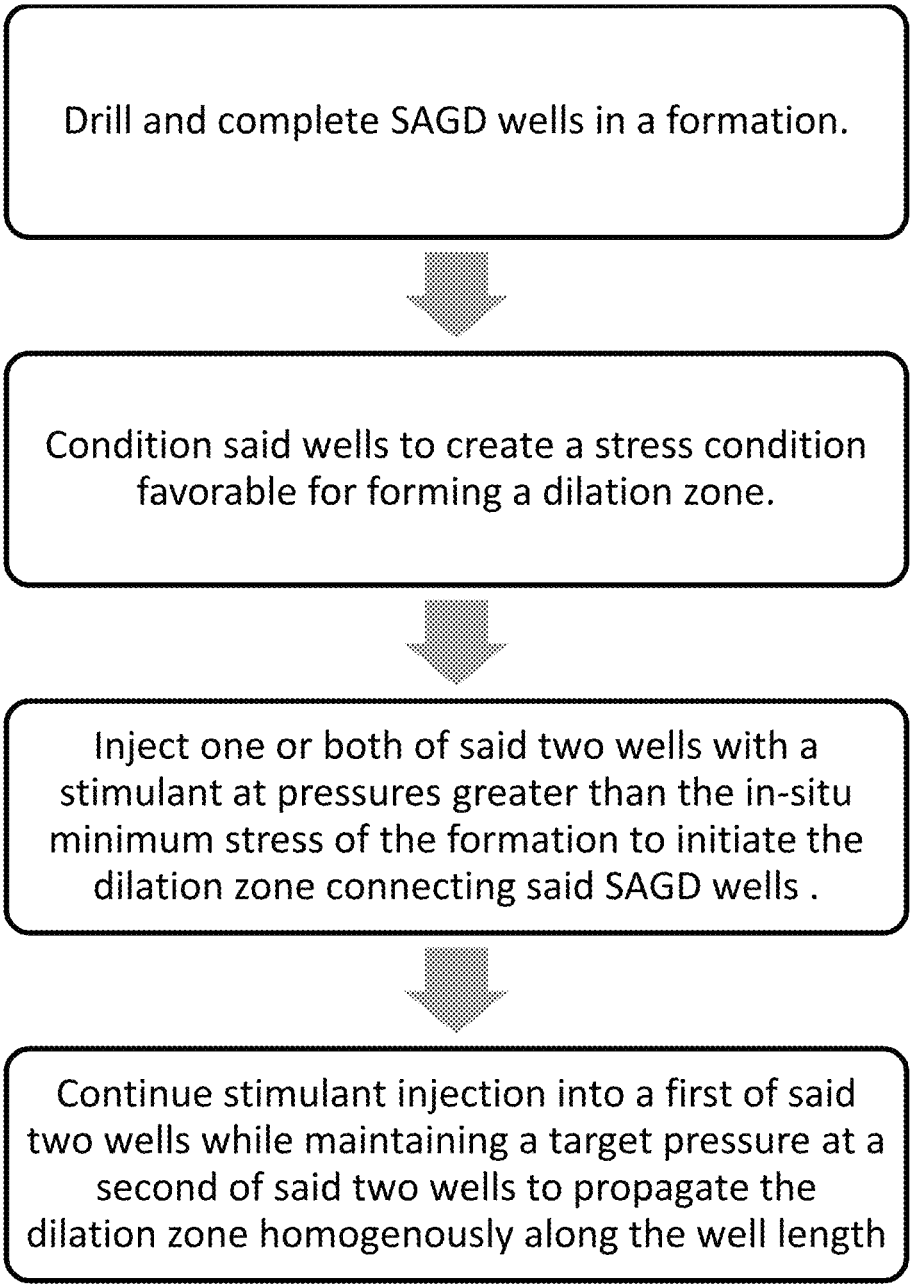
FIG. 5 is a schematic diagram of one embodiment of a method of the present invention.

The steps of the method of the present invention are generally schematically provided FIG. 5.

Two wells 4 are drilled in a substantially horizontal direction, substantially parallel and substantially co-planar in the vertical direction, as seen in FIG. 1. In the SAGD operation, the wells are typically drilled in the formation 2 along the oilsands deposit channels. They can be oriented in any direction with respect to the in-situ minimum or maximum horizontal stress direction.

Moreover, any number of local inhomogeneities may be present in the wells drilled 4, as seen in FIG. 2. These include, but are not limited to, laterally undulating well path seen in 2*a*, substantially vertically co-planer but with some degree of horizontal offset seen in 2*b*, the horizontal open hole is not perfectly cylindrical seen in 2*c*, wells being not perpendicular to the in-situ minimum horizontal stress as seen in 2*d*, or different lithological faces with varying oil saturations may be present between the wells and/or along the well length as seen in 2*e*.

The length of the horizontal SAGD wells can vary, and can preferably be from 400 m to 800 m. The present method does not require that the horizontal wells be segmented into subsections via downhole packers. However, it is possible and encompassed by the scope of the present invention to divide the SAGD well pair into multiple segments and apply the present method to each of these segments.

Figure 3:
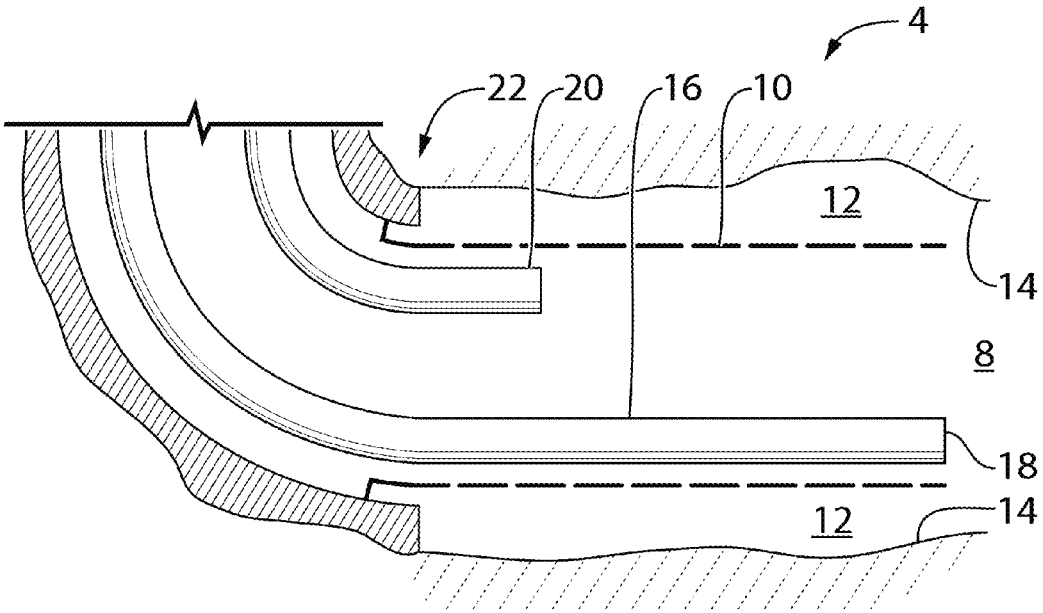
FIG. 3 illustrates one typical well of SAGD completion.

FIG. 3 shows one well of a typical SAGD well completion diagram, as illustrated in FIGS. 1 and 2, two such wells 4 would exist in each SAGD pair. The well 4 comprising a long horizontal open hole section 8 that is typically not cemented. A horizontal liner 10 with slotted openings and/or wire-wrappings is inserted. There is an open annulus 12 between the liner 10 and excavated sand face 14. Inside the liner 10, a first long tubing 16 is deployed to the end of the horizontal well section, called the toe 18. A second short tubing 20 is also inserted to the start of the horizontal well section, called the heel 22. Variations to the orientation and completion of the wells are also possible and would be well understood by a person of skill in the art to be encompassed by the scope of the present invention. For example, in some situations there may be a portion of the formation that is particularly difficult to produce from, and it may be desirable to separately dilate and stimulate this portion. In such circumstances it may also be possible to insert a third tubing into one or two of the SAGD well pair, said third tubing reaching to the selected portion of the formation and the present method can preferably be applied to this kind of well completion. In fact, there is no limitation in the present method on how the SAGD well pair is drilled or completed.

After the SAGD wells 2 are drilled and completed, the following preferable stages of the present method are conducted: (1) Conditioning stage; (2) Dilation initiation stage; (3) Dilation zone propagation stage; and (4) Dilation transition. It would be well understood by a person of skill in the art that these stages may be changed and that some may be deleted and still fall within the scope of the present invention.

Figure 4:
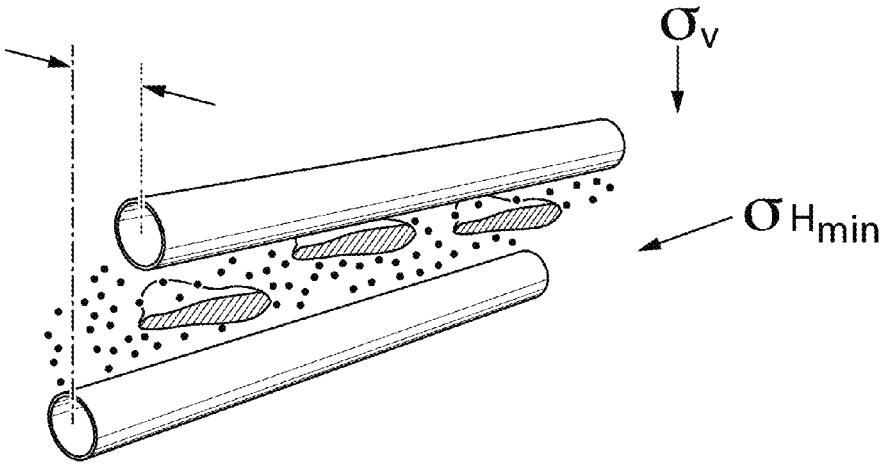
FIG. 4 illustrates a well pair showing the dilation zone formed by the steps of the present method.

In the conditioning step, the upper well 28 and the lower well 30 are conditioned via controlled injection into one or both of the wells 4. Well injection acts to alter the original in-situ stress conditions of the formation via poroelastic and/or thermoelastic mechanisms to form a new stress condition so that a dilation zone 26 can be formed. This is depicted in FIG. 4.

Conditioning relies on pressure diffusion fronts from each of the said two wells to interact with one another. The faster the pressure diffusion, the earlier the conditioning step can be completed. Pressure diffusion depends on the effective fluid mobility in the formation. Anything that can increase fluid mobility will help. Therefore, one or more of the following means can be used to enhance conditioning, although other means of increasing fluid mobility enhancement are also possible and would be clearly understood by a person of skill in the art as being encompassed by the scope of the present invention:

(1) Injection with water to increase the relative permeability to water;

(2) Injection of warm water to reduce the bitumen viscosity. Warm-up of the well tubings via a brief period of steam circulation at the start will help to maintain the temperature of the injected warm water;

(3) Injection of chemical solvent or solution of certain chemicals to reduce the bitumen viscosity; or (4) Injection or circulation of steam.

Pressure diffusion increases the pore pressure inside the formation 2, evoking the poroelastic stress buildup. Similarly, temperature diffusion increases the temperature inside the formation, evoking the thermostatic stress buildup. Both poroelastic and thermoelastic stresses are similar in their benefits to conditioning. However, in general, temperature diffusion is slower than the pore pressure diffusion. Thus, injection at a higher pressure is more efficient than injection at a high temperature. Simultaneous high pressure and high temperature injection is most preferred for the purposes of the present invention.

The conditioning injection pressure preferably starts below the original in-situ minimum stress ($S_{min0}$). Preferably, known methods can be used, such as performing a mini-frac test to measure the original in-situ minimum stress. As the pore pressure increases in the formation 2, the in-situ stresses increase due to the poroelastic mechanism. Thus, after injecting over a certain period of time, it is possible to increase the injection pressure to somewhat above $S_{min0}$. Such an increased injection pressure is beneficial to conditioning. Preferably increased injection pressure is monitored to prevent the formation of macroscopic tensile fractures, by injecting at a rate lower than that required to induce a fracture in the formation.

Many variations are possible in terms of injection pressure, injection rates, injected materials and so on during the conditioning stage. Most preferably both wells are simultaneously injected, while in some circumstances, injection into one well is preferred. For example, if a bottom water layer is present in the reservoir, it is beneficial to limit injection into the lower of said two SAGD wells to avoid communication with the bottom water. More preferably, the bottom well can be injected or circulated with steam, to improve viscosity reduction above the well since steam tends to rise. In such circumstances of a bottom water being, the upper well can more preferably be injected with solvent or chemical solution, it promotes viscosity reduction via the gravity-driven fluid movement downwards.

Injection can also be initiated with regular water such as produced water from water treatment plants.

Furthermore, temporal alterations can vary between the two wells. In all the cases, the materials, pressure, temperature and coordination between wells depend on specific geological situations, convenience and economics. Geomechanical simulations based on the specific circumstances may optionally be used to determine optimum strategy for conditioning.

With reference to FIG. 3, conditioning injection can proceed in any manner between the long tubing 16 and the short tubing 20 of a well. If the initial formation injectivity is high, conditioning injection can be initiated in both tubings simultaneously. If the initial injectivity is low, conditioning injection can be initiated in the long tubing 16 first while maintaining a production rate or pressure at the short tubing 20.

The conditioning stage modifies the in-situ stress field around the SAGD wells to favor a substantially vertical and dilation-dominated failure zone to be formed, connecting said two wells. Completion of this stage can be determined by analyzing injection rate and pressure history data. If necessary, geomechanical history-matching can also be performed. Interference tests normally available in the pressure transient analysis can be used to check if the pressure/temperature diffusion fronts from each of said two wells have interacted with each other.

Stimulant injection rate and time can be determined on-site based on the real-time monitored well injection pressure. If the pressure increase is too slow, the rate can be increased. If the pressure rises too fast, the rate should be reduced. Site-based real-time pressure monitoring methods and devices are well known in the art and are included in the scope of the present invention.

Preferably, stimulant injection rates are initially slower to probe and assess characteristics of the formation, before a higher rate is used. For example, if injection into one well results in slow pressure increase in the well, it may mean that the well is connected with a permeable zone such as a zone with a higher water saturation. In such cases, injection is preferably limited to maintain a target pressure at that well while injecting mostly at the other well. If the other well has a similar high injectivity, it means that the wells have established good communication with each other and the method can progress to the dilation transition stage earlier.

The stimulant material to be injected can vary, so long as it serves to raise formation pressure and it does not harm the hydraulic conductivity of the formation being fractured, any material can be injected. For the purposes of the present invention, stimulant includes water, steam, solvent, suitable chemical solutions or other materials or their mixture in any portion. The stimulant viscosity can also range from approximately 1 centipoise (cp), as in the case of water, to high-viscosity stimulants whose viscosity values can be determined in the design works.

The stimulant can be at any temperature: below, equal or substantially above the original temperature of the formation. Furthermore, stimulant type and temperature to be injected during the conditioning phase can vary between the two wells. For example, cold or warm solvent-containing water may be injected into a first well while the second well may be injected with steam. Moreover, the injection materials and/or temperature can change over time on the same well(s).

The timing of the conditioning stage depends on the in-situ conditions and stimulant material properties. Preferably, geo-mechanical simulations can be run prior to conducting the methods of the present invention to provide details on such properties and to estimate conditioning timing. Further preferably, field pilot tests can be run in a particular area to fine-tune the timing.

After the in-situ stress field around the SAGD wells is conditioned to favor a substantially vertical dilation zone 26 to be formed, the next steps are to initiate this dilation zone 26 and propagate it uniformly along the well length. To initiate a dilation zone 26, the injection pressure is gradually increased by increasing either the injection rate or injection pressure above the original in-situ minimum stress, $S_{min0}$. It is noted that although $S_{min0}$ provides a good reference to determine injection pressure or injection rate, geo-mechanical simulations as well as site-specific pilot tests are also preferred methods of fine-tuning the injection pressure and rate parameters. Ultimately, initiation of the dilation zone 26 can be observed by monitoring the injection pressure and/or rate. If the injection is maintained at a constant rate, the increased injectivity is reflected by greatly decelerated pressure increase rate, or nearly flat or even decreasing pressure. If the injection is maintained at a constant pressure, the increased injectivity is reflected by an increased demand of more volume to be injected in order to maintain the constant pressure.

During initiation of the dilation, injection can be carried out at one or both of the two wells. In some situations when initiation of the dilation zone 26 from one well is not preferred, high-pressure injection should be carried out at the other well.

Once a dilation zone 26 has been initiated, the end of the dilation initiation stage can be confirmed by shutting-in one well while the other well continues the injection. When pressure at the shut-in well increases, it means that the two wells are in pressure communication with each other. The operation can then progress to the dilation zone propagation stage.

After the dilation is initiated, the injection rate and pressure are preferably managed to propagate the dilation zone 26 homogeneously along the horizontal well length so that a continuous dilation zone 26 is formed connecting the two wells. Homogenous dilation can be achieved by a number of means.

One method of achieving homogenous dilation includes rate controlled injection at one well while the other well is pressure-controlled. In this case, pressure is preferably high enough to promote homogenous dilation in the inter-well region along the well length, while also depressing or slowing down propagation of the dilation zone 26 to areas other than the inter-well region. One example of using this method is to avoid propagating the dilation zone to the bottom water layer.

In a SAGD well 4 as depicted in FIG. 3, injection into the long tubing 16 at a controlled flow rate (also called rate controlled injection) promotes dilation moving from the toe 18 towards the heel 22. If the heel 22 is under pressure control, it can slow down or suppress the dilation near the heel 22 or arrest the dilation when it moves closer, provided the pressure of injection is managed.

The above combination of rate- and pressure-control injection can alternate between the long tubing 16 and short tubing 20 of each well 4 or between an upper well 28 and a lower well 30. Such alternation can repeat. At each injection point, the rate or pressure can gradually increase, decrease or remain steady.

After the homogenous dilation propagation stage, the present method transitions to circulating steam to warm up the inter-well region. Preferably heat or solvent is used for viscosity-reduction purposes. For the purposes of the present invention steam is used as one example viscosity-reduction agent although it would be understood by a person of skill in the art that solvents and chemical solutions may also be used and are encompassed by the scope of the present invention.

The dilation zone 26 formed between the SAGD wells and along the well length creates a conduit for steam to travel through. Without the dilation zone 26, thermal energy contained in the steam would mostly travel by diffusion to impact the inter-well region.

By creating a dilation zone 26, convection contributes a great deal to transport of thermal energy. Moreover, with dilation, the contact area for steam with the bitumen becomes much larger and more targeted to connect the SAGD well pair than the cylindrical surface co-axial with the SAGD wells. As a result, viscosity reduction between the wells is greatly accelerated.

More preferably, measures can be taken to optimize use of the dilation zone 26 between the SAGD wells. For example, steam circulation and/or injection pressure can be set near but lower than the maximum pressure used in the previous dilation stages.

A higher steam injection pressure may be used in some circumstances and may be beneficial for the dilation transition stage. In such cases steam injection pressure should still remain within the domain of promoting dilation, i.e. using $S_{min0}$ as a reference threshold. Moreover, after the normal SAGD production starts, the high steam injection pressure is preferably stopped in order to prevent adverse impact on the caprock integrity.

The viscosity-reduced hot bitumen drains downwards below the injector well due to gravity, following channels of the dilation zone 26. Initially, temperature is still low in the dilation area. The hot bitumen passing through this cold area becomes cooler, increasing its viscosity and slowing down its downward movement. Eventually, it may temporarily stop moving down further. This phenomenon is referred to as bitumen banking. Some measures can be taken to reduce the occurrence and effects of bitumen banking, including but not limited to:

a. Circulating steam at a higher pressure in the lower producer well than in the upper injector well; or
b. Injecting, circulating or soaking a liquid solvent or chemical solution into both the injector well and the producer well. Injection, circulation or soaking can vary between the wells, or vary with time on the same well, or follow other combinations which would be well understood by a person of skill in the art.

Generally it would be understood by a person of skill in the art that the injections performed in each of the conditioning, dilation initiation and dilation zone propagation stages of the present method can have a number of variations. In each step, and in each tubing of each well, the rate-control or pressure-control modes can vary. The resulting non-exhaustive list of combinations can include:

| Upper Injection Well | |
|---|---|
| Short Tubing | Long Tubing |
| Pressure Controlled | Pressure Controlled |
| Pressure Controlled | Pressure Controlled |
| Pressure Controlled | Pressure Controlled |
| Pressure Controlled | Pressure Controlled |
| Pressure Controlled | Rate Controlled |
| Pressure Controlled | Rate Controlled |
| Pressure Controlled | Rate Controlled |
| Pressure Controlled | Rate Controlled |
| Rate Controlled | Pressure Controlled |
| Rate Controlled | Pressure Controlled |
| Rate Controlled | Pressure Controlled |
| Rate Controlled | Pressure Controlled |
| Rate Controlled | Rate Controlled |
| Rate Controlled | Rate Controlled |
| Rate Controlled | Rate Controlled |
| Rate Controlled | Rate Controlled |
| **Lower Production Well** | |
| Short Tubing | Long Tubing |
| Pressure Controlled | Pressure Controlled |
| Pressure Controlled | Rate Controlled |
| Rate Controlled | Pressure Controlled |
| Rate Controlled | Rate Controlled |
| Pressure Controlled | Pressure Controlled |
| Pressure Controlled | Rate Controlled |
| Rate Controlled | Pressure Controlled |
| Rate Controlled | Rate Controlled |
| Pressure Controlled | Pressure Controlled |
| Pressure Controlled | Rate Controlled |
| Rate Controlled | Pressure Controlled |
| Rate Controlled | Rate Controlled |
| Pressure Controlled | Pressure Controlled |
| Pressure Controlled | Rate Controlled |
| Rate Controlled | Pressure Controlled |
| Rate Controlled | Rate Controlled |

Furthermore, the above combinations of rate-controlled or pressure-controlled injection can vary with time over the course of each stage of the present method.

Initiation of the transition stage depends on a number of factors. If steam circulation in the transition stage can proceed at high pressures similar to that needed for the dilation, the transition can be activated earlier. The high-pressure steam injection can play the role of the high-pressure water injection in the propagation stage. Otherwise, it is preferred to prolong the high-pressure water injection for promoting more dilation.

A more preferred way to determine when to end the dilation propagation stage is by history-matching the injection pressure and/or the injection rate data. Such matching may be used to estimate for what well length the two wells are in communication.

The present method is based on the theory that it is possible to pre-condition formations to induce targeted vertical dilation zones, regardless of whether the original in-situ stress condition favours a vertical dilation zone. The present method utilizes poroelastic or thermoelastic mechanisms to alter or enhance the original un-disturbed in-situ stress conditions in oilsands reservoirs in a conditioning stage, so that a vertical dilation zone can be initiated and propagated.

Poroelastic stress comes from the interaction between pore pressure and solid deformation. The general theory of poroelasticity was established by Biot (1941) although the particular case of poroelasticity relating to interaction between deformation and pressure diffusion was studied earlier by Terzaghi (1923) for soils. Poroelastic effects in rock mechanics related to petroleum engineering were first noted by Geertsma (1957, 1966).

Thermoelastic stress comes from the interaction between temperature and solid deformation. Physically, an increase in the pore pressure (p) or temperature (T) causes rock to expand. Such expansion is constrained by the material outside the domain of p/T increase. The restriction introduces an additional stress component to the original undisturbed in-situ stress field in the formation. Such induced stresses are called the poroelastic or thermoelastic stresses depending on if the causing mechanism is pore pressure increase or temperature increase.

This detailed description of the present processes and methods is used to illustrate certain embodiments of the present invention. It will be apparent to a person skilled in the art that various modifications can be made and various alternate embodiments can be utilized without departing from the scope of the present application, which is limited only by the appended claims.

The invention claimed is:

1. A method of creating one or more dilation zones connecting two SAGD wells, said method comprising the steps of:

a. drilling and completing the SAGD wells in a formation;
b. conditioning said wells by injecting at a pressure less than an in-situ pressure of the formation to utilize one or more of poroelastic mechanisms and thermoelastic mechanisms to create a stress condition proximal to said wells favorable for forming one or more vertically oriented dilation zones;
c. injecting one or both of said two wells with a stimulant at pressures at least greater than an in-situ minimum stress of the formation to initiate the one or more dilation zones connecting said SAGD wells; and
d. continuing stimulant injection at a target value to propagate the one or more dilation zone homogenously along a well length, wherein conditioning is carried out until pressure diffusion fronts from each of the said two wells interact with one another but before dilation initiates.

2. The method of claim 1, wherein each well comprises a first tubing and a second tubing.

3. The method of claim 2, wherein conditioning said wells comprises injecting stimulant into the said wells at an injection rate lower than that required to induce a fracture in the formation.

4. The method of claim 3, wherein the injection is monitored and controlled by monitoring and controlling the injection rate.

5. The method of claim 4, wherein rate controlled injection comprises injection at a rate that is selected from the group consisting of a constant rate, an increasing rate, a decreasing rate and an increasing then decreasing rate.

6. The method of claim 5, wherein rate controlled injection occurs simultaneously into both SAGD wells.

7. The method of claim 5, wherein rate controlled injection occurs alternately between a first well and a second well of the two wells.

8. The method of claim 5, wherein the injection rate at each of said SAGD wells is selected from the group consisting of a similar rate in each of SAGD wells and different rates in each of said SAGD wells.

9. The method of claim 8, wherein the injection rate in the first tubing and the second tubing of each of said SAGD wells is selected from the group consisting of a similar rate in the first and second tubing and different rates in the first and second tubings.

10. The method of claim 2, wherein the injection is monitored and controlled by monitoring and controlling the injection pressure.

11. The method of claim 10, wherein pressure controlled injection comprises injection at a pressure that is selected from the group consisting of a constant pressure, an increasing pressure, a decreasing pressure and an increasing then decreasing pressure.

12. The method of claim 11, wherein pressure controlled injection occurs simultaneous into both SAGD wells.

13. The method of claim 11, wherein pressure controlled injection occurs alternately between a first well and a second well of the two wells.

14. The method of claim 11, wherein the injection pressure at each of said SAGD wells is selected from the group consisting of a similar pressure in each of SAGD wells and different pressures in each of said SAGD wells.

15. The method of claim 14, wherein the injection pressure in the first tubing and the second tubing of each of said SAGD wells is selected from the group consisting of a similar pressure in the first and second tubing and different pressures in the first and second tubings.

16. The method of claim 2, wherein the stimulant is one or more materials selected from the group consisting of water, steam, solvents and chemical solutions.

17. The method of claim 2, wherein conditioning the wells serves to increase pore conditions selected from the group consisting of pore pressure and pore temperature in the formation around the two wells.

18. The method of claim 2, wherein initiation of the dilation zone is carried out by continuing stimulant injection at a pressure above an original in-situ minimum stress.

19. The method of claim 18, wherein initiation of the dilation zone is monitored and controlled by monitoring and controlling the injection pressure.

20. The method of claim 19, wherein pressure controlled injection comprises injection at a pressure that is selected from the group consisting of a constant pressure, an increasing pressure, a decreasing pressure and an increasing then decreasing pressure.

21. The method of claim 20, wherein pressure controlled injection occurs simultaneous into both SAGD wells.

22. The method of claim 20, wherein stimulant is injected alternately into a first and then a second well of the two wells.

23. The method of claim 20, wherein the injection pressure at each of said SAGD wells is selected from the group consisting of a similar pressure in each of SAGD wells and different pressures in each of said SAGD wells.

24. The method of claim 23, wherein the injection pressure in the first tubing and the second tubing of each of said SAGD wells is selected from the group consisting of a similar pressure in the first and second tubing and different pressures in the first and second tubings.

25. The method of claim 19, further comprising producing well fluids in order to maintain a target injection pressure.

26. The method of claim 18, wherein initiation of the dilation zone is monitored and controlled by monitoring and controlling an injection rate.

27. The method of claim 26, wherein rate controlled injection comprises injection at a rate that is selected from the group consisting of a constant rate, an increasing rate, a decreasing rate and an increasing then decreasing rate.

28. The method of claim 27, wherein rate controlled injection occurs simultaneous into both SAGD wells.

29. The method of claim 27, wherein stimulant is injected alternately into a first and then a second well of the two wells.

30. The method of claim 27, wherein the injection rate at each of said SAGD wells is selected from the group consisting of a similar rate in each of SAGD wells and different rates in each of said SAGD wells.

31. The method of claim 30, wherein the injection rate in the first tubing and the second tubing of each of said SAGD wells is selected from the group consisting of a similar rate in the first and second tubing and different rates in the first and second tubings.

32. The method of claim 18, wherein the stimulant is one or more materials selected from the group consisting of water, steam, solvents and chemical solutions.

33. The method of claim 32, wherein stimulant temperature is selected from the group consisting of below, equal or above an original temperature of the formation.

34. The method of claim 33, wherein stimulant type and stimulant temperature vary between the two wells.

35. The method of claim 1, wherein propagation of a homogeneous dilation zone along the well length comprises rate controlled injection into one of said two wells and pressure controlled injection into the other of said two wells.

36. The method of claim 35, wherein pressure controlled injection is maintained at a pressure sufficient to promote homogenous dilation in an inter-well region along the well length.

37. The method of claim 35, wherein rate controlled injection and pressure controlled injection are alternated between the two wells.

38. The method of claim 35, wherein the rate of rate controlled injection and the pressure of pressure controlled injection are varied.

39. The method of claim 35, wherein the rate of rate controlled injection and the pressure of pressure controlled injection are increased.

40. The method of claim 35, wherein the rate of rate controlled injection and the pressure of pressure controlled injection are decreased.

41. The method of claim 1, further comprising the steps of circulating steam via one or both of said two wells and through an inter-well region along the well length.

42. The method of claim 41, further comprising circulating a viscosity reducer, said viscosity reducer being selected from the group of solvents and chemical solutions.

43. The method of claim 41, wherein steam circulation is conducted at a pressure lower than an original in-situ minimum stress of the formation.

44. The method of claim 41, wherein steam circulation is conducted at a pressure higher than an original in-situ minimum stress of the formation.

45. The method of claim 41, wherein steam is circulated at a higher pressure in a first well and lower pressure in a second well.

46. The method of claim 45, wherein the first well is a lower production well and the second well is an upper injector well.

47. The method of claim 41, further comprising adding a liquid solvent to one or both of the wells by means selected from the group consisting of injecting, circulating and soaking.

48. The method of claim 47, wherein addition of the liquid solvent varies between the wells.

49. The method of claim 47, wherein addition of the liquid solvent varies with time.

* * * * *